United States Patent [19]

Droege, Sr. et al.

[11] 3,961,869

[45] June 8, 1976

[54] AIR COMPRESSOR

[75] Inventors: Arthur John Droege, Sr., Sheboygan, Wis.; Richard Charles Bell, Pittsburgh, Pa.

[73] Assignee: Thomas Industries, Inc., Sheboygan, Wis.

[22] Filed: Sept. 26, 1974

[21] Appl. No.: 509,691

[52] U.S. Cl. ..... 417/555 R; 92/171; 417/566

[51] Int. Cl.² ..... F04B 21/04; F01B 7/00

[58] Field of Search ..... 416/555, 550, 566, 490, 416/415, 437; 92/144, 169

[56] References Cited

UNITED STATES PATENTS

| | | | |
|---|---|---|---|
| 1,451,033 | 4/1923 | Todd | 417/550 |
| 1,883,328 | 10/1932 | Biltl et al. | 417/490 |
| 2,138,605 | 11/1938 | Landis | 417/566 |
| 2,576,200 | 11/1951 | Rotz | 417/566 |
| 2,723,052 | 11/1955 | Yuza | 417/566 |
| 2,836,474 | 5/1958 | Mosher | 417/437 |
| 2,842,284 | 7/1958 | Flick | 92/169 |
| 2,963,217 | 12/1960 | Wysong, Jr. | 417/550 |
| 2,985,358 | 5/1961 | Lee et al. | 417/490 |
| 3,331,328 | 7/1967 | Smith et al. | 417/415 |
| 3,628,427 | 12/1971 | Bailey | 92/144 |

*Primary Examiner*—William L. Freeh

*Attorney, Agent, or Firm*—Johnson, Dienner, Emrich & Wagner

[57] ABSTRACT

The invention provides an air compressor of low cost, high quality, long life and of simple and rugged construction and ready replaceability of the chief wear parts as a unit. The compressor employs a wobble piston with a Teflon or equivalent packing on the wobble piston, which packing bears against the surface of a working cylinder of aluminum with a hardened polished surface. The working cylinder in the form of a cylindrical sleeve is seated at its lower end on a circular shoulder in the main housing or frame. At its upper end it is seated and sealed in a groove in a head plate which provides a cylinder head for the cylinder and a closure for the top of the main frame. An inverted cup shaped delivery chamber rests upon and is secured to and sealed by an O-ring of heat resistant rubber to the head plate to receive the delivery of compressed gas and to provide anchorage for a delivery pipe or pipes. The discharge check valve of flanged duck bill formation is held in place by pressure fit of a metal ring in an annular recess, which ring engages and retains the flange of the discharge valve. The Teflon cup leather is clamped to the end of the combined piston and connecting rod by press fitting a ring of metal upon the cylindrical end of said piston, and heat is dissipated from the compressed gas through contact with metal parts which communicate directly, conductively, with outside air and/or radiation cooled surfaces. The Teflon cup and polished cylinder are self-lubricating; the crank shaft and crank pin are self-lubricating by the use of either oil impregnated bushings or by the use of ball bearings; efficiency of compression is aided by the provision of minimum clearances between the piston, the cylinder head, and the discharge check valve. The structure disclosed herein permits of replacement of the working parts consisting of the head plate with a sealing O-ring, and an affixed cylinder with a discharge check valve along with the wobble piston and rod, all assembled as a unit.

2 Claims, 6 Drawing Figures

FIG. 1
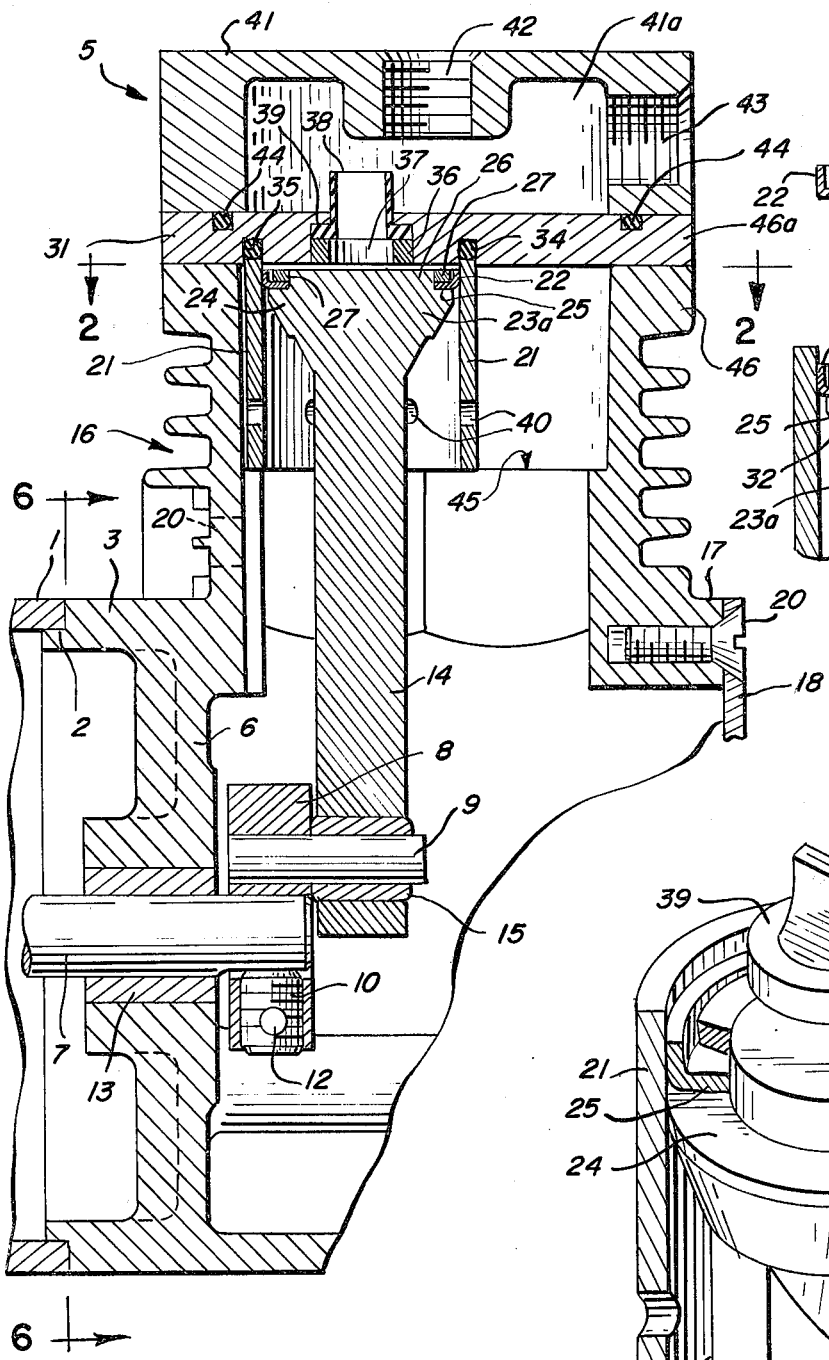
FIG. 5
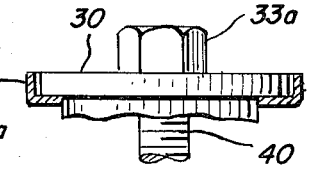
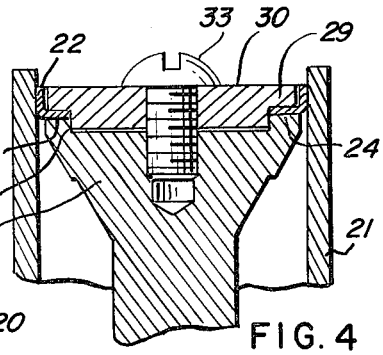
FIG. 4
FIG. 3
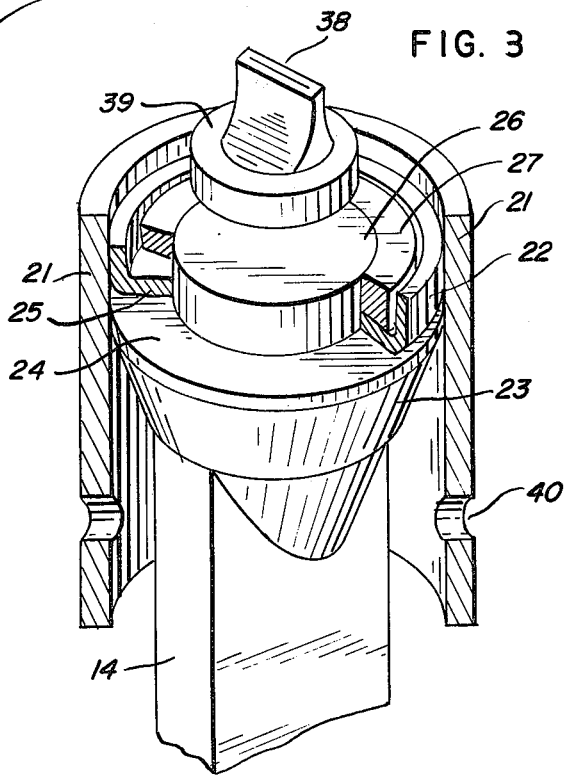

AIR COMPRESSOR

The present invention relates to gas compressors, more particularly to low cost, high speed air compressors suitable for heavy duty with little or no maintenance or servicing, the wear parts of which are renewable.

CROSS REFERENCE

The present invention is an improvement on the prior invention of the same applicants disclosed in their copending application, Ser. No. 444,472, entitled "Air Compressor".

BACKGROUND OF THE INVENTION

In heavy duty vehicle transportation, material handling, and like heavy machinery, compressed air as a control operating medium is in common use. There is a demand for small motor driven air compressors to supply control air and service pressure. The present invention provides a compressor simple in structure, low in cost, and reliable in performance. The parts which are subject to heavy duty and/or high temperature are renewable as a unit or subassembly.

SUMMARY OF THE INVENTION

The invention resides in the arrangement and construction of parts combined to provide continuity and reliability of operation and ease of repair. Economy and continuity of service are seen in the elimination of any internal screw threaded parts which could come loose, or become leaky, in the course of extended operation. Reliability will be found in the arrangement of parts which provides efficiency as a compressor—that is, the movement of gas from atmospheric to a pressure storage vessel through an efficient arrangement of parts and through a structure which combines simplicity and tightness of the joints with adequate heat dissipation paths which avoid overheating with its consequent dangers and with the working parts renewable as a replaceable unit. The substitution of press fits for screw thread connections marks the structure for efficiency, and the uninterrupted pathways for the dissipation of heat insure the safety and continuous operation of the device.

BRIEF DESCRIPTION OF THE DRAWING

FIG. 1 is a vertical axial section of the working parts of the compressor of our invention;

FIG. 3 is an isometric diagrammatic view of the duckbill discharge valve, the cylinder, and the wobble piston with its cup leather;

FIG. 4 is a vertical section through the end of the wobble piston and connecting rod showing a modification of the piston structure;

FIG. 5 is an illustration similar to FIG. 4 wherein the clamping screw for clamping the cup leather retainer is designed to reduce the clearance in the discharge passageway to the check valve.

DESCRIPTION OF THE PREFERRED EMBODIMENT

Figure 2:
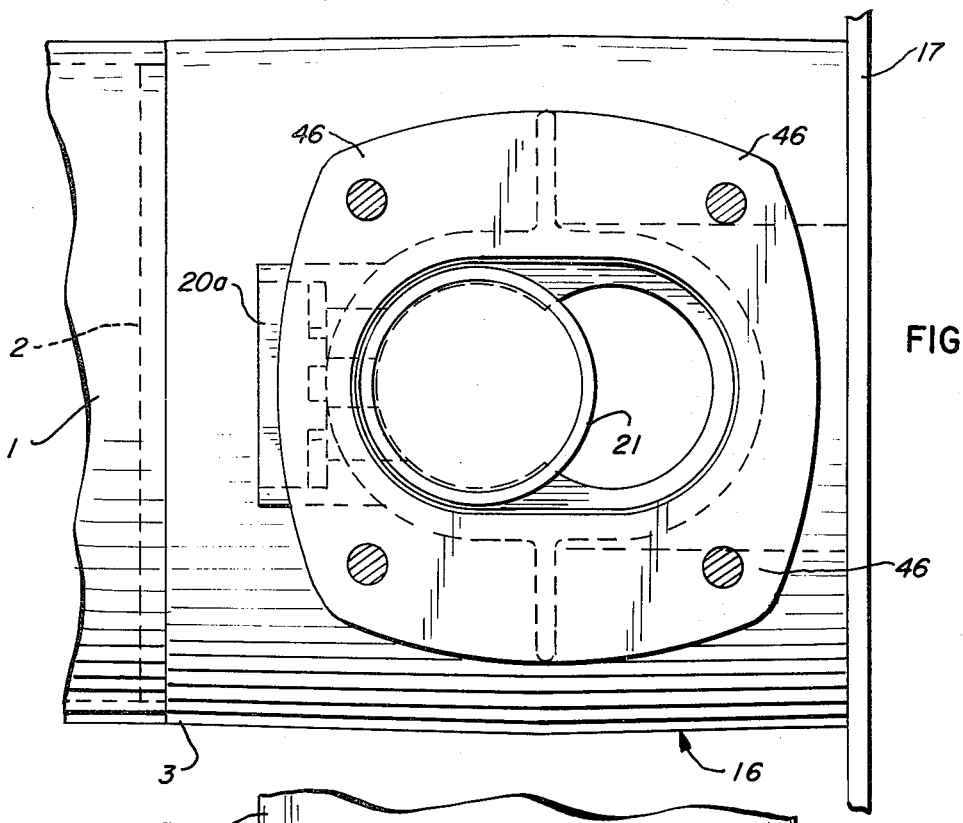
FIG. 2 is a plan view illustrating the relation of the major parts of the compressor.
Figure 6:
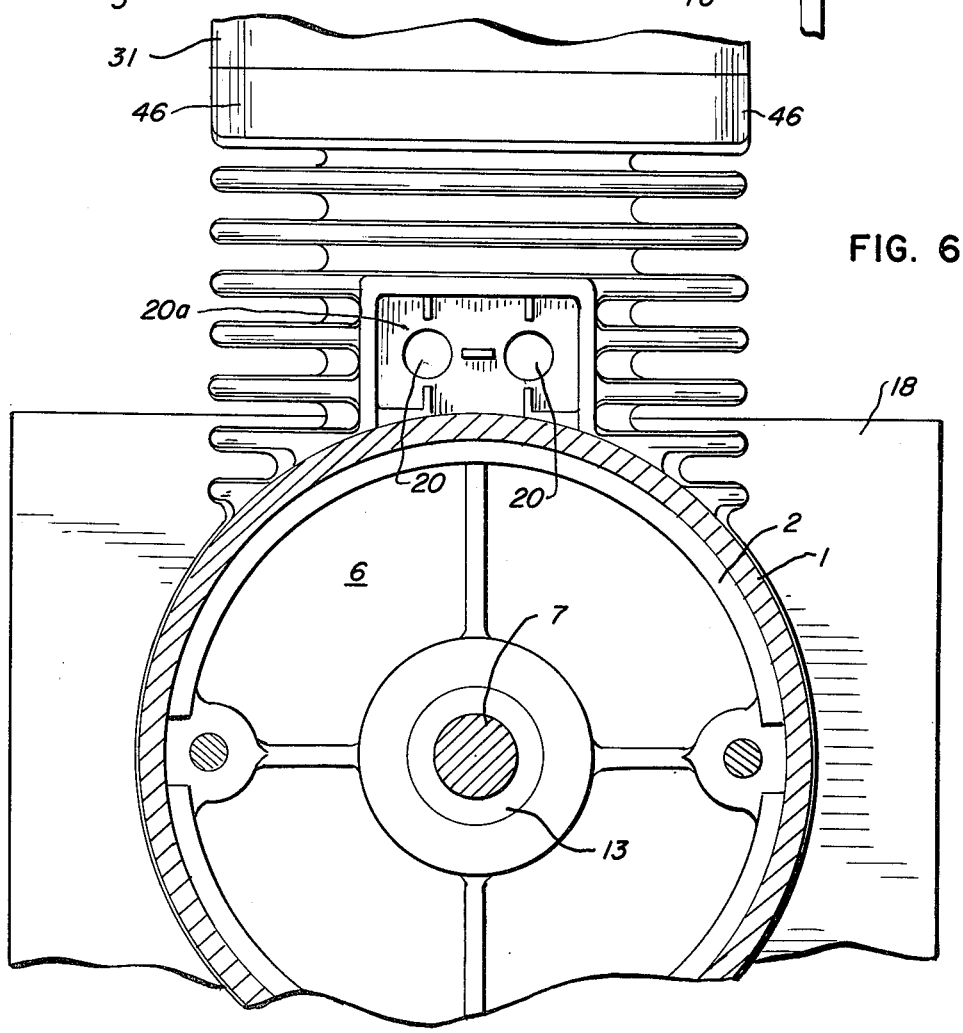
FIG. 6 is an end view taken from the left of FIG. 1 on line 6—6.

Referring to FIGS. 1 and 2, a cylindrical motor frame or shell 1 has a flanged telescopic joint 2 with a corresponding bell shaped coupling member 3 which forms a part of the crank case housing of the compressor. The bell housing 3 of the compressor contains a transverse vertical wall 6 which divides the cylindrical space which houses the electric motor and its parts on the left of the wall 6 from the working parts of the compressor leaving, however, communication between the two through the motor shaft 7 which serves, along with its service as the motor shaft, the duty of a crank shaft for the compressor. A crank arm 8 bearing a crank pin 9 is mounted on the end of the motor shaft 7 and connected thereto by the metallic set screw 10 of the so-called "self-locking" type found on the market under the name of "NYLOK", or so-called "Patch" type, bearing on a flat seat on the end of shaft 7. The crank pin 9 of uniform diameter is permanently set into the crank disc 8 by a press fit.

The shaft 7 is mounted in a bearing 13 which is of porous metal structure charged with a lubricant providing lubrication for an extended indefinite period. A ball bearing would serve the same purpose, but at a higher cost.

The connecting rod 14 bears at its lower end a self-lubricating oil filled bushing 15 similar to the main bearing 13 also constructed for operation indefinitely without further lubrication. For bearings 13 and 15, ball or roller bearings may be substituted according to the requirements of the user; such are bulkier and more expensive.

The flange 3 which joins the crank case housing 6 to the motor housing 1 constitutes an integral part of the compressor frame 16. The frame is preferably a unitary casting carrying the aforesaid disc-like dividing wall 6 forming one end of the crank case considered in the longitudinal direction of the shaft 7. The opposite end of the crank case has a flange 17 which by means of screws 20 provides attachment for a plate 18 which serves to close the end of the crank case 16 and serves also as a mounting plate for mounting the motor-compressor unit in a suitable location.

The air inlet 20 to the interior of the crank case (which communicates with the cylinder inlet ports 40) opens into a pocket 20*a*. A filter (not shown) may be disposed in the pocket 20*a*.

The cylinder enclosing portion of the compressor casting or housing 16 establishes the radial position relative to the crank shaft 7 of the compressor cylinder 21. This cylinder 21 comprises an aluminum alloy cylindrical sleeve, the inner surface of which has been hardened and polished, in a manner well known in the art, to provide a smooth, long life wearing surface for cooperating with the Teflon cup leather 22 of the piston 23.

The piston 23 which is formed integral with the upper end of the connecting rod 14 has an annular shoulder 24 upon which rests the radially extending flange 25 of the cup leather 22. The extreme upper end of the integral piston and piston rod comprises a short cylindrical boss 26 which forms the extreme upper end of the integral piston rod and piston 14, 23. The high strength metal ring 27 having an inner cylindrical wall is press fitted over the boss 26 holding down the inturned flange 25 of the cup leather member (see FIG. 3). The cup leather member is made of sheet Teflon which has well known wear resisting qualities.

An alternative construction for performing the functions of the preferred construction shown in FIG. 1 is illustrated on an enlarged scale in FIG. 4 wherein the cup leather has its planar flange 25 held between the shoulder 24 of the wobble piston and the flange 29 of the piston head member 30 which has the cylindrical piloting projection fitted and clamped into the socket 32 in the end of the wobble piston head 23*a*, as will be seen by comparing the structure of FIG. 4 with the structure of FIG. 1. If a press fit is desired without the screw 33, the recess in the end of the piston may be extended axially to cover a greater area. The press fit of FIG. 4 is similar to that of FIG. 1 with the difference, however, that the inertia of the holding ring 27 of FIG. 1 is of a lower amount than that of the clamping disc 30 shown in FIG. 4. The arrangement of the parts in FIG. 4 subjects a part of slightly larger mass—namely, the annular plate 30 and screw 33—to the forces of inertia during the operation of the compressor than is the case when the ring 27 is force fitted upon the projecting end 26 of the piston 23. Each construction has its own advantage.

A desideratum is to subject minimum mass to the inertia forces of reciprocation of the wobble piston and connected parts, consistent with adequate service life.

An important feature of the invention is the method of dissipating heat produced by gas compression. In the structure herein disclosed the function of sealing pressure retaining parts to each other is performed by the utilization of a gasket of small circular cross section, such as an O-ring. This is a toroidal ring of heat resistant elastic compound held in a groove of rectangular cross section in the planar metal surface of one member, and wherein a cooperating planar surface of a cooperating pressure retaining metal member engages the cylindrical surface of the gasket to complete the fluid tight seal. The cooperating planar parts provide an extensive direct metal-to-metal surface contact for mechanical support or connection of the two metallic members against each other, and for transmission of heat from one to the other with very little reduction in heat transferability between the parts due to the O-ring seal between said parts. Thus the flow of heat from the cylinder and the cylinder head outwardly through solid heat conducting paths is not compelled to pass through large area flat gaskets which greatly hinder such flow. In the present compressor the cylinder and cylinder head and pressure chamber have direct metal-to-metal contact with outside metal parts exposed to direct heat dissipation.

As shown in FIG. 1 the horizontal head plate 31 which carries the cylinder 21 on its lower side also carries the duck bill discharge valve 38 and it carries the sealing O-ring 44 in a groove for sealing the said plate to the flat circular surface of the discharge chamber member 41 as well as the seal of the cylinder 21 to the cylindrical supporting plate 31. The significance of this arrangement lies in the fact that the working parts of the compressor are free to be removed and replaced as a unit assembly. This is made possible through the provision for separability of the working parts as a unit from the main frame with room for the separation to be accomplished, whereby the worn motor driven compressor unit may be provided with a unitary replacement of the parts subject to wear. This is done by releasing the bolts (FIG. 2) which clamp the chamber member 41 down upon the cylinder supporting plate 46a and said plate 46a upon the flange 46 of the cylinder frame 16. Thereupon the plate 46a with attached cylinder may either be lifted off of the piston, and the piston and rod removed separately, or the plate 46a, with cylinder 21 and containing wobble piston 23 and piston rod 41, may be slid laterally over to the right as viewed in FIG. 1 on the shoulder 45 far enough, off of the crank pin 9. Thereupon the unit consisting of the rod, the piston, the cylinder, the plate, the duck bill discharge valve 38 and the sealing O-ring 44 may all be lifted out of the cylinder frame 16 and replaced by a unit replacement of new parts by moving the new parts in the same path as that of the removal of the worn parts — but in the opposite direction. While it may not be necessary to remove the old unit as a unit, it is desirable to provide room for the assembled renewal elements to be installed as a unit. It will be noted that the renewal unit may carry a fresh O-ring 44 whereby the working parts and the necessary seals are renewed throughout.

In the present construction the cylinder 21 is a thin walled metallic (aluminum) cylinder mounted and restrained endwise between the internal shoulder 45 on the inside wall of the frame 16 and the sealing O-ring 35 in the groove 34 in the combined cylinder head and delivery chamber wall member 31.

In the construction of the parts joined for fluid pressure, tight fits such as the cylinder 21 at its upper end being fitted into the groove 34 which retains the O-ring 35, the coefficients of thermal expansion of the cylinder 21 and of the cylinder supporting plate 31 should be close together to avoid loosening after long service. Since the fluid pressure of compression is in the direction of holding these rings in place, they tend to remain tight.

The structure herein illustrated and described embodies novel concepts in heat dissipation of the compressed gas.

While the cylinder walls are not lubricated, the friction of the Teflon cup leather 22 against the cylinder walls is low due to the nature of the rubbing surfaces.

The hollow frame or shell 16 is ribbed circumferentially relative to the axis of the cylinder to provide extensive heat transfer area from radiation and for air flow, which in the case of a road vehicle may be very considerable. The thin walled cylinder 21 of high heat conductivity is surrounded by the incoming air at ports 20—20. This incoming air is churned up by the rotating crank 8 and piston rod 14 which tends to equalize the temperature of the air engaged parts and to dissipate heat through the ribbed containing walls.

The generation of heat is maximum at the upper end of the cylinder and at the cylinder head 31. This head 31 is a rather extensive plate which allows heat of compression to flow out through the plate 31 to the housing 16 which has extensive heat dissipating surfaces. The crank case 16 and mounting plate 18 also deliver heat through the internal cooling medium of the stirred up air in the crank case—that is, in contact with heat dissipating surfaces.

The cylinder head—in this case the part of plate 31 bounded by the annular groove 34 and O-ring 35—is subject directly to the heat of compression of the gas. The top of the cylinder wall of the sleeve 21 is also subjected to the temperature of the compressed gas.

There are several additional routes for the escape of heat of compression. The first is directly from the internal surface of the cylinder head 31 over the sealing ring 35 and out through the cylinder head 31, the outer margins of which are clamped metal-to-metal to the top of the ribbed cylinder container 16. Radiation of heat from the upper end of the cylinder to the internal walls of the ribbed upper part of the housing 16 also provides an effective heat escape route.

The same situation prevails in the delivery chamber 41a. This chamber comprises an inverted cup-shaped casting exposed exteriorly to heat dissipation by radiation and convection clamped by its flanges to the cylinder head plate 31 without a flat intervening gasket. This is accomplished by virtue of the O-ring seal 44 which provides a gas seal but allows an extensive raw metal surface for engagement by the plate 31 which, as above pointed out, allows the heat to travel down through the metal-to-metal engagement of the flanges of the delivery chamber member 41 through plate 31 to the combined frame and housing member 16 which is circularly ribbed or flanged along its length for the dissipation of heat.

By combination of the metal-to-metal contact for mechanical support and heat conductivity, and an O-ring which provides a pneumatic seal, an excellent mechanical structure with high heat dissipation ability and excellent strength and pneumatic tightness is provided in a simple and compact structure.

In FIG. 4, the screw 33 may serve not only as the holding function of the plate 30 but also as a displacing member in the discharge duct formed on the inside of the press fit ring 36 which constitutes the exit passageway for compressed gas as the piston 23*a* moves outwardly during each revolution of the crank shaft 7. Alternatively, as shown in FIG. 5, a polygonal or circular displacement pin 33*a* may project from the top of the piston 23*a* into the discharge passageway 37 which leads to the discharge valve 38.

The discharge valve 38 is of the structure known as duck bill, illustrated on a larger scale in FIG. 3. The duckbill valve 38 is constructed of an elastomer which may be synthetic rubber or rubberlike material capable of enduring an elevated temperature.

The duckbill discharge valve comprises an annular flange ring 39 which is seated in an annular counterbore in the discharge plate 31, as illustrated in FIG. 1, held in place against the shoulder in said bore 37 by the press fit retaining ring 36. The duckbill valve 38 comprises the flange 39 from which rises the body of elastomer formed into a duckbill consisting of two flat sides joined at their edges. The duckbill is capable of being opened by internal pressure—that is, upwardly in the direction shown in the drawings—but to be firmly closed by pressure upon the outside of the same.

OPERATION

The operation of the device, it is believed, will be apparent from the foregoing description. However, assuming the parts to be in the position shown in FIG. 1, rotation of the crank shaft motor shaft 7 in its oil-soaked metal bearing 13 rotates the crank pin 9 which likewise has a self-lubricated bushing 15. By said rotation of the shaft 7, the lower end of the piston rod 14 describes a circular motion which is translated by the guidance of the cylinder 21 into rocking and reciprocating motion of the piston 23 which rides up and down in the cylinder 21. As the piston 23 moves downwardly to its lowermost extent it will uncover the inlet ports 40 and allow entry of air from the crank case due to atmospheric pressure. Air normally enters and replaces withdrawn air from the crank case by entry through the inlet openings 20 through a filter (not shown). The Teflon cup-leather riding against the polished inside wall of the cylinder 21 engenders a minimum of friction and consequent transformation of mechanical movement into heat.

The upward motion of the piston proceeds to the limit, such as indicated in FIG. 1, with or without displacement by a projecting pin or the like into the passage through the ring 37 and through the discharge outlet provided by the duckbill valve 38 which serves as a check valve of great sensitivity. The compressed gas is discharged into the chamber 41a. From there it may be directed through either the top outlet 42 or the side outlet 43, whichever is more convenient. The pressure chamber member 5 is sealed against the plate 31 by a groove in the plate and O-ring 44 as shown in FIG. 1.

Since no body of free liquid lubricant is involved in the compressor of the invention, it is relatively immaterial how the compressor is mounted so long as there is access to cooling by air flow internally and externally of the compressor. The mechanical construction of the compressor is designed to promote cooling of the working parts by air flow over parts to which heat is conducted in the operation of the device. The employment of O-rings between pressure retaining parts which are also subject to requirements for heat transfer is a distinctly novel feature in the present compressor. Thus the connection of the cylinder 21 with the head plate 31 involves the utilization of an O-ring in a groove into which the upper end of the cylinder member 21 is fitted and held in the groove 34 by the shoulder 45 of the containing frame member 16. This puts the connected parts into good pneumatically sealed and thermally conductive relation. The same provision is made for conducting heat from the head plate 31 to the ribbed tubular portion 16 of the hollow frame which encases the cylinder.

We claim:

1. In a gas compressor, a hollow main frame comprising a generally cylindrical crank case adapted to be disposed with its longitudinal axis in horizontal position and having a substantially vertical end wall, a horizontal crank shaft extending through and journaled in said end wall, said frame comprising a tubular neck portion disposed substantially at right angles to the axis of the crank case, said neck portion being joined to and opening into said crank case, a substantially horizontally disposed cylinder supporting plate mounted upon and closing the upper end of said tubular neck portion, an inverted cup-shaped delivery chamber having its rim superposed upon the margins of the upper side of the cylinder-supporting plate, a compressor cylinder with its axis substantially at right angles to the axis of the crank shaft mounted to and sealed to the lower side of said plate, there being a check valve passageway through said plate from the inside of the cylinder to said delivery chamber, a wobble piston and a piston rod fixed to said piston cooperating with said cylinder, a crank on said crank shaft coupled to said piston rod, and means for admitting air to the cylinder upon the outward stroke of the piston, said neck portion of the main frame having an internal horizontal shoulder for engagement with the lower end of said cylinder, the bore of the hollow neck portion being oblong in cross section to permit displacement of the cylinder laterally along said crank shaft to disconnect the lower end of the piston rod from the crank pin for removal of the cylinder and contained piston with piston rod from the hollow main housing.

2. The combination of claim 1 wherein the upper clamping surface of the cylinder and discharge valve supporting plate has an O-ring groove opening toward and registering with the cooperating clamping surface of the rim of the cup-shaped delivery chamber and having a sealing O-ring mounted and carried in said groove, and adapted to engage the lower clamping surface of said delivery chamber, the lower side of said plate being clamped directly upon the upper end of said tubular neck portion whereby replacement of the cylinder and discharge supporting plate carries with it replacement of all the necessary gaskets.

* * * * *